United States Patent [19]

Jungkind

[11] Patent Number: 4,765,640

[45] Date of Patent: Aug. 23, 1988

[54] CROSS-COUNTRY SKI BINDING

[75] Inventor: Roland Jungkind, Garmisch-Partenkirchen, Fed. Rep. of Germany

[73] Assignees: Metallwerk K. Pittl GmbH & Co. KG, Australia; Sportschuhfabriken Adi Dassler Stiftung & Co. KG, Fed. Rep. of Germany

[21] Appl. No.: 33,802

[22] Filed: Apr. 3, 1987

Related U.S. Application Data

[62] Division of Ser. No. 796,018, Oct. 22, 1985, Pat. No. 4,682,785.

[30] Foreign Application Priority Data

Feb. 22, 1984 [DE] Fed. Rep. of Germany ..... 3406439
Jul. 20, 1984 [DE] Fed. Rep. of Germany ..... 3426856

[51] Int. Cl.[4] ..... A63C 9/00
[52] U.S. Cl. ..... 280/615; 280/631
[58] Field of Search ..... 280/614, 615, 623, 624, 280/626, 628, 631, 632, 635

[56] References Cited

U.S. PATENT DOCUMENTS 1,580,292 4/1926 Easdale et al. ..... 280/615
4,266,805 5/1981 Weigl ..... 280/615
4,411,445 10/1983 Kregenbahl ..... 280/615

*Primary Examiner*—John J. Love
*Assistant Examiner*—Richard Camby

[57] ABSTRACT

Cross-country ski bindings (51) for cross-country ski boots (54) having a forwardly extended front sole end (55) formed as a downwardly directed hook, with a transverse member (58) which is provided for co-operating with the sole end (55) and which is mounted in side jaws (57) which extend upwardly from a base plate (56) which is to be fixedly mounted to the ski. In order to maintain the front end (55) of the sole in place with respect to the transverse member (58), the arrangement has the web portion (59) of a U-shaped stirrup member (59, 60), the limb portions (60) of which are mounted at their free ends on the transverse member (58). The U-shaped member (59, 60) is subjected to the force of a spring (62) which urges it in the direction of clamping the front end (55) of the sole in place. The boot (54) is pivotable about the transverse member (58) against the resistance of the spring (62).

4 Claims, 6 Drawing Sheets

CROSS-COUNTRY SKI BINDING

Figure 1:
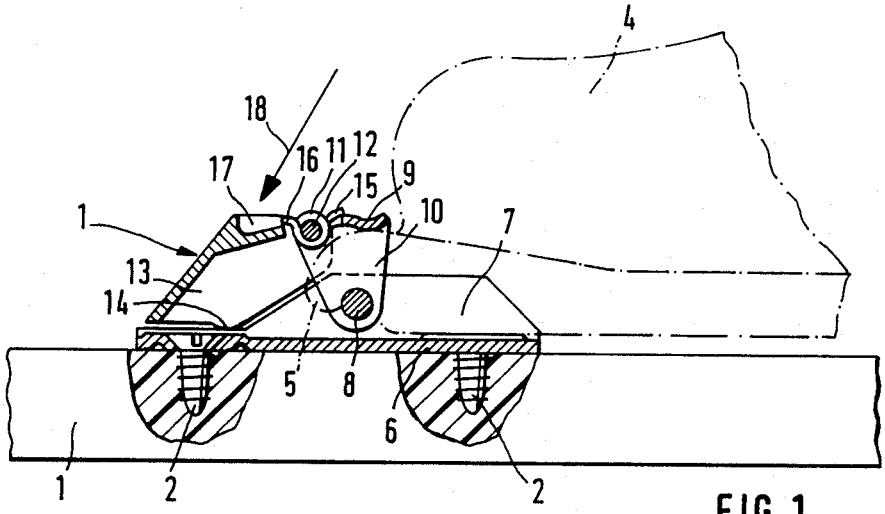

This is a division of application Ser. No. 796,018, filed Oct. 22, 1985, now U.S. Pat. No. 4,682,785, issued 7-28-87.

The present invention relates to a cross-country ski binding for cross-country ski boots with a forwardly extended front sole end which is formed as a downwardly directed hook, with a transverse member which is provided for co-operation with the end of the sole and which is mounted in side jaws which extend upwardly from a base plate which is to be fixedly mounted on the ski.

Cross-country ski bindings of that kind are already known from German laid-open application (DE-OS) No. 28 29 564. In comparison with other known cross-country ski bindings, they afford the advantage of being of a particularly simple construction which is not liable to give trouble as there is no need to bend either the forwardly extended end of the sole nor a part of the ski binding, when lifting the ski boot off the ski.

In the case of the cross-country ski bindings of the general kind set forth above, the transverse member is part of a bent wire stirrup member which at the same time serves for securing the connection of the ski boot to the ski binding. For that purpose, a special retaining projection is required, on the forwardly extended end of the sole. In addition, the wire stirrup member extends upwardly away from the surface of the ski, in the condition of use thereof. Furthermore, those known cross-country ski bindings do not provide for pivotal movement of the ski boot on the transverse member against a resistance which is initially low and which then progressively increases.

The present invention aims to provide such a configuration of the cross-country ski binding of the general kind set forth, that the above-indicated defects and disadvantages are eliminated.

In accordance with the invention, that is achieved in that, for the purposes of pivotally mounting the front end of the sole in the binding, there is provided a U-shaped stirrup member whose limb portions are mounted at their free ends on the transverse member and whose web portion extends parallel with respect to the transverse member, thereby forming a frame for accommodating the front end of the sole, and that the U-shaped member is subjected to the force of a spring which loads it in the direction of clamping the front end of the sole in position and the boot is pivotable about the transverse member against the resistance of the spring.

That construction no longer requires a special retaining projection on the forwardly extended end of the sole of the cross-country ski boot. Furthermore, that arrangement also no longer has any part which extends dangerously upwardly away from the ski. The spring for loading the U-shaped member on the one hand secures the boot in its fitting in the ski binding and on the other hand gives a progressively increasing resistance acting against the boot upon pivotal movement thereof.

A first construction has been found to be desirable, wherein the U-shaped member is formed as a crank arm and is connected by way of a journal member to a thrust member which is pivotable and longitudinally displaceable relative to the base plate. In a further development of that concept of the invention, a particularly simple construction is achieved in that the thrust member bears with a projection against the base plate and is held in its inner limit position under the force of the spring and that the spring is in the form of a coil torsion spring and is mounted on the journal member. In that case, the spring performs a double function in that it loads on the one hand the thrust member and on the other hand the stirrup member.

In order to facilitate both insertion of the boot into the ski binding and also release thereof from the ski binding, a design configuration of the present invention provides that disposed on the thrust member is a locking lever which has a lock hook or catch. In that arrangement, the base plate has a co-operating barb or catch portion which is intended to co-operate with the lock catch and the locking lever is loaded in the direction of unlocking by a holding spring.

That construction permits the locking lever to be latched as desired to the base plate whereby the ski binding thus has a fixed open position. After the boot has been inserted into the ski binding, the latter is to be lifted at the rear, in the manner of a running movement, until the top side of the front end of the sole comes into contact with the web portion of the stirrup member whereafter, upon further pivotal movement of the boot, by virtue of entrainment of the stirrup member, the latching of the locking lever to the base plate is automatically released and the cross-country ski binding is thus in its condition of use.

In a design configuration of that concept of the invention, it has been found to be advantageous for the locking lever to be pivotally mounted to the thrust member in parallel relationship to the journal member. That arrangement provides that the cross-country ski binding is not only simple to produce but also simple to operate.

An embodiment of the cross-country ski binding according to the invention in which there is no thrust member that is longitudinally displaceable on the base plate and which is thus even simpler and more resistant to wear, is achieved in that the web portion of the stirrup member is provided with a cradle configuration which extends in the longitudinal direction of the ski and which is disposed in opposite relationship to the transverse member, and that provided for co-operating with the stirrup member is a locking lever which is mounted on a spindle in parallel relationship to the transverse member, in the side jaws, and is loaded in the unlocking direction by a holding spring.

In that construction, the spring which loads the stirrup member is preferably in the form of a coil tension spring and is connected to the spindle of the locking lever.

In accordance with a further feature of the invention, the holding spring may be formed as a coil torsion spring and may be mounted on the spindle of the locking lever. That construction makes it possible to provide a compact and concentrated design.

Figure 2:
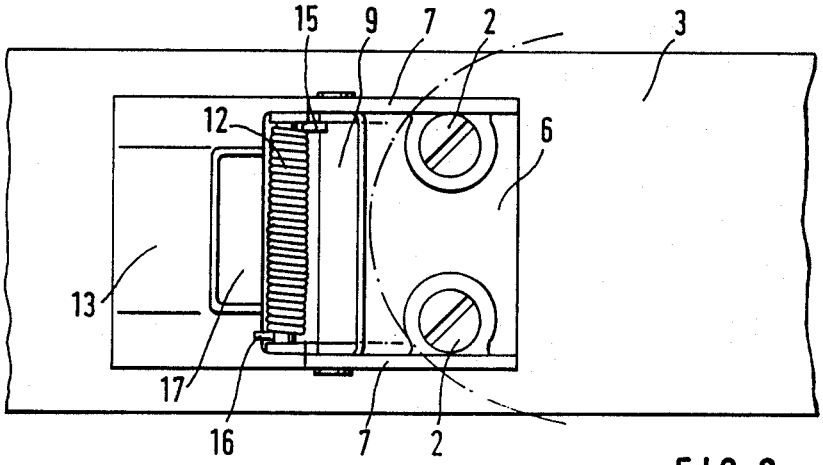
Figure 3:
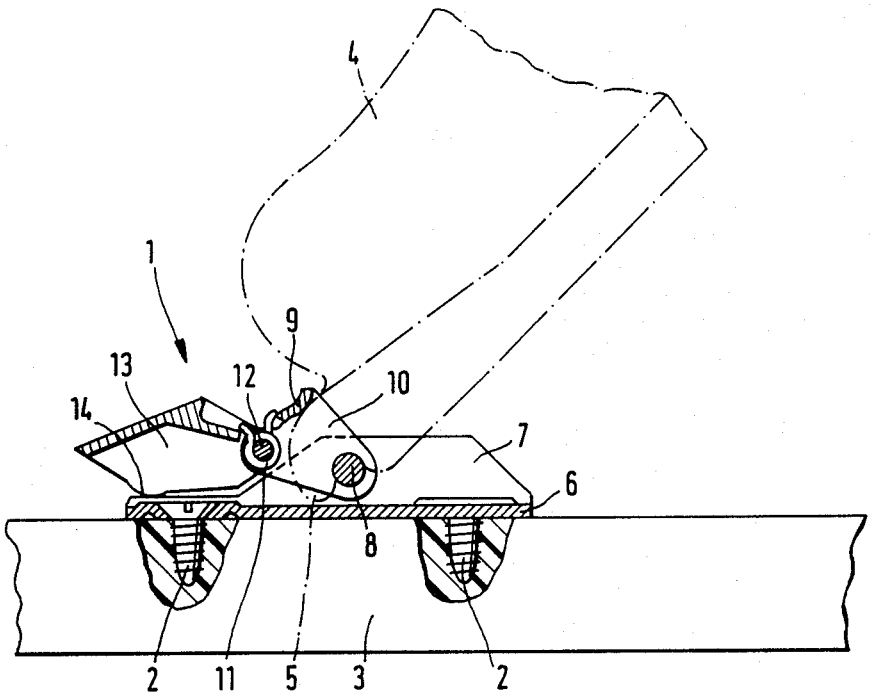
Figure 4:
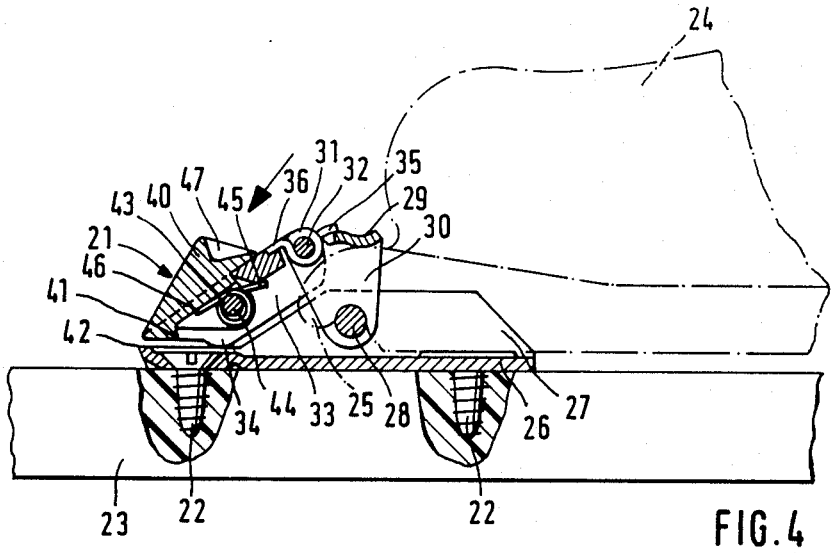
Figure 5:
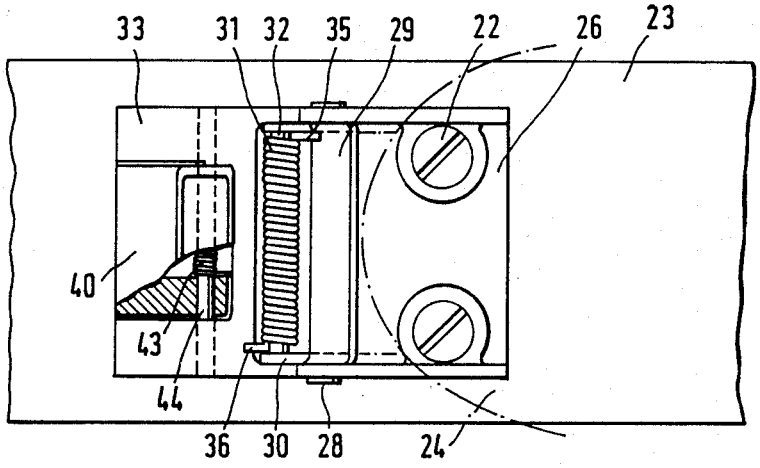
Figure 6:
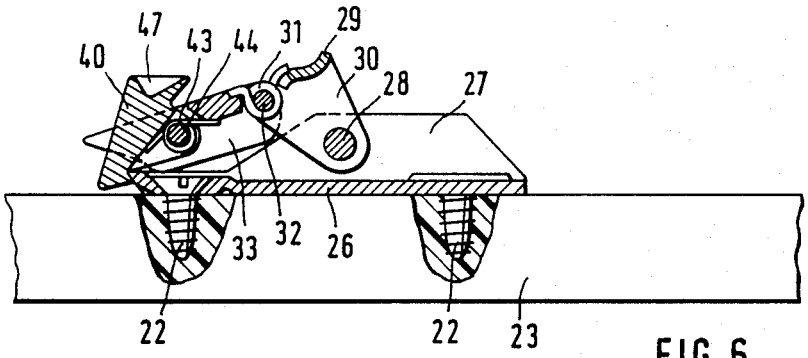
Figure 7:
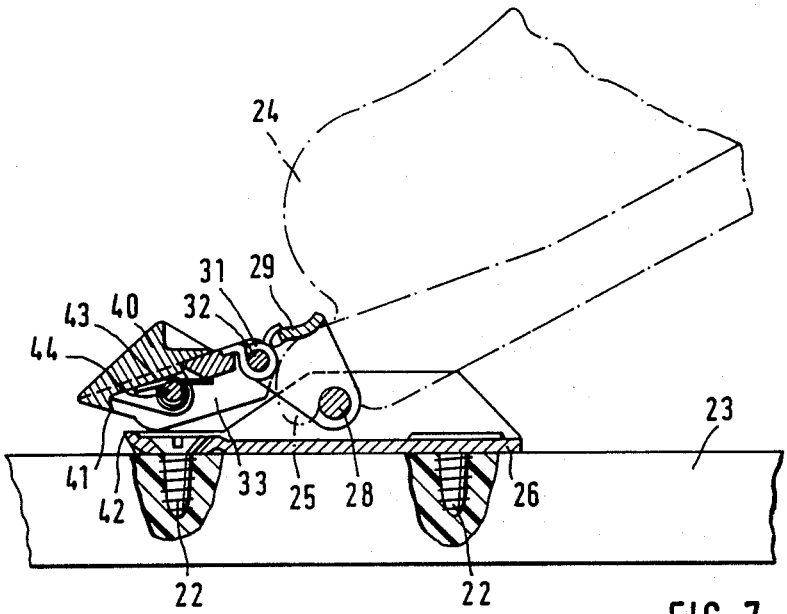
Figure 8:
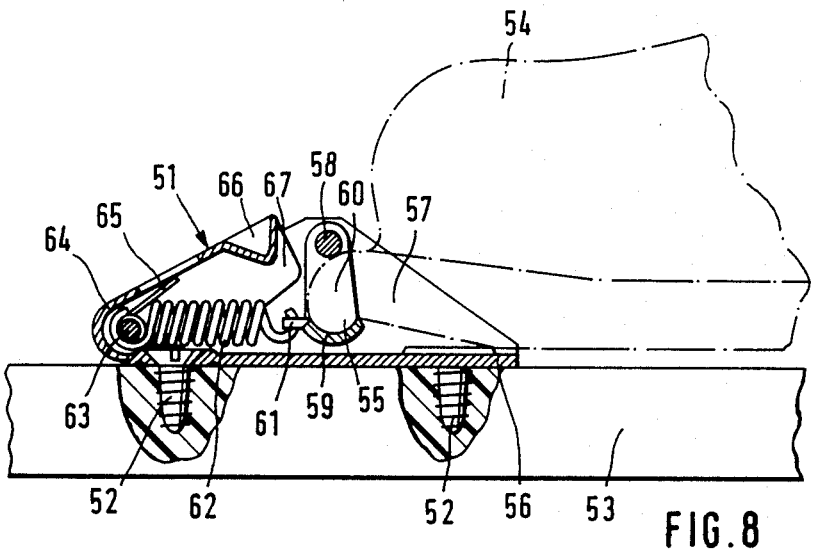
Figure 9:
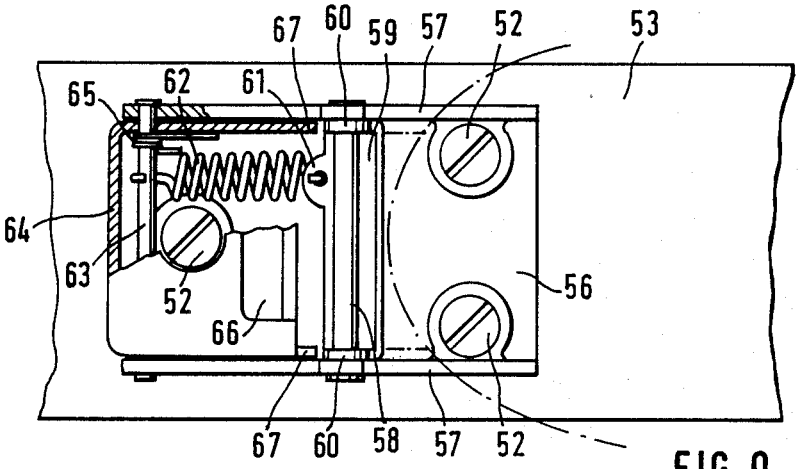
Figure 10:
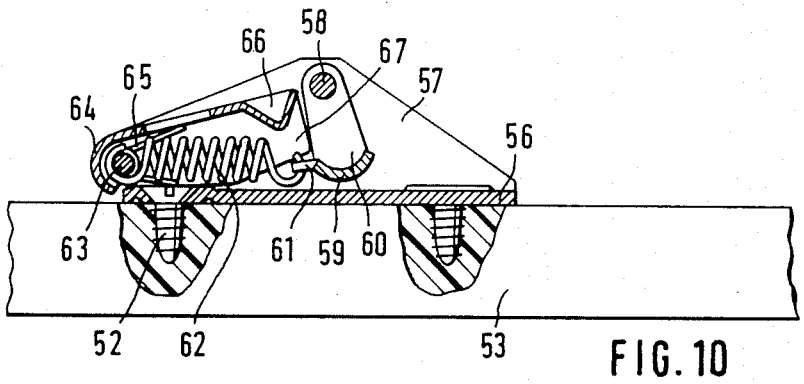
Figure 11:
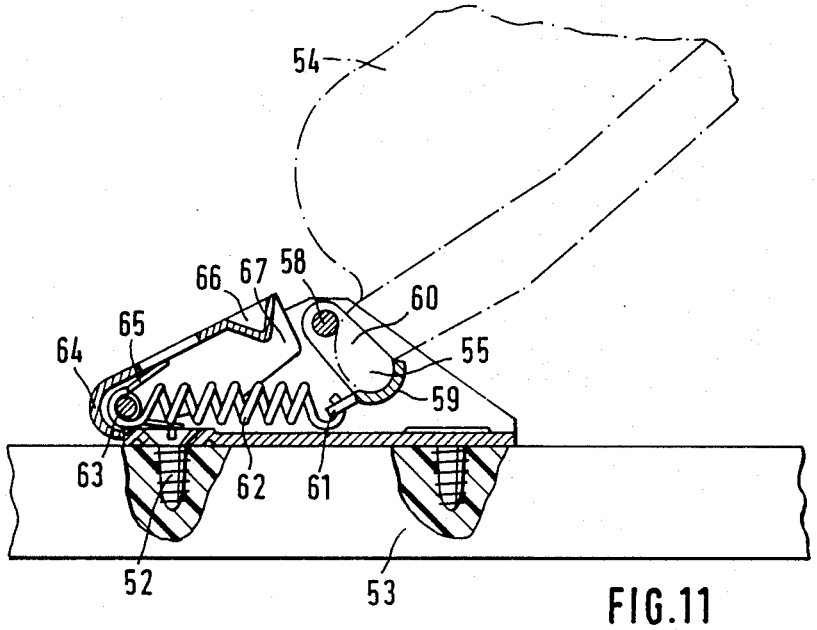

Embodiments of the cross-country ski binding according to the present invention are described in detail hereinafter with reference to the accompanying drawings in which:

FIG. 1 is a view in central longitudinal section of a first embodiment of the cross-country ski binding, FIG. 2 is a plan view of the cross-country ski binding, FIG. 3 is a view in section corresponding to that shown in FIG. 1, in the instantaneous condition with the cross-country ski boot pivoted upwardly, FIG. 4 is a view in central longitudinal section of a cross-country ski binding in a second embodiment, FIG. 5 is a plan view of the cross-country ski binding shown in FIG. 4, FIG. 6 is a view in section corresponding to FIG. 4 of the binding in the open position, FIG. 7 is a view in section corresponding to that shown in FIG. 4 in the instantaneous condition with the cross-country ski boot pivoted upwardly, FIG. 8 is a view in central longitudinal section of a cross-country ski binding in a third embodiment, FIG. 9 is a plan view of the cross-country ski binding shown in FIG. 8, FIG. 10 is a view in section corresponding to that shown in FIG. 8 in the open position of the binding, and FIG. 11 is a view in section corresponding to that shown in FIG. 8 in the instantaneous condition with the cross-country ski boot pivoted upwardly.

The cross-country ski boot as shown in FIGS. 1 through 3, denoted generally by reference numeral 1, is secured to a cross-country ski 3 by means of screws 2. A cross-country ski shoe or boot is indicated in dash-dotted lines, and denoted by reference numeral 4. The ski boot has a forwardly extended front end 5 of its sole, which is formed as a downwardly open hook. The ski binding includes a base plate 6 with upwardly extending side jaws 7 in which a transverse member 8 is mounted. The transverse member 8 serves to co-operate with the hooked end 5 of the sole. Mounted on the transverse member by means of its limb portions 10 is a U-shaped stirrup member which, when the cross-country ski boot is inserted, embraces the front end of the sole thereof and secures it with its web portion 9 to prevent it from lifting away from the transverse member 8.

The stirrup member forms a crank arm to which a thrust member 13 is connected by way of a journal member 12. The thrust member 13 bears by means of a projection 14 against the base plate 6 or, to put that in a better way, against narrow strips of its side edges which are formed by continuation portions of the side jaws 7. Fitted onto the journal member 12 is a coil torsion spring 11 of which one leg 15 bears against the web portion 9 of the stirrup member while the other leg 16 of the spring bears against the thrust member 13. The thrust member 13 is also provided on its top side with a depression 17 which serves for inserting the tip of a ski stick.

FIG. 1 shows the cross-country ski binding in its normal position. The stirrup member and the thrust member 13 are held in the illustrated position under the influence of the spring 11. For the purposes of inserting a ski boot into the ski binding, a pressure is to be applied to the thrust member 13, for example by means of the tip of a ski stick, in the direction indicated by the arrow 18. That causes a pivotal movement of the stirrup member on the transverse member 8 in the anti-clockwise direction, in relation to the drawing, so that the ski binding takes up the position thereof shown in FIG. 3. In that position, with the sole in an approximately horizontal position, the front end 5 of the sole can be hooked onto the transverse member 8. When the thrust member 13 is then relieved of the pressure applied thereto, the arrangement then goes back to the position shown in FIG. 1. The web portion 9 of the stirrup member is clamped fast on the top of the forwardly extended end 5 of the sole, under the force of the spring 11. In the course of cross-country skiing, there is then a continuous change in position between the positions shown in FIGS. 1 and 3, with the transverse member 8 forming a real pivot axis for the cross-country ski boot. For the purposes of releasing the ski boot from the binding, the stirrup member is once again to be pivoted relative to the ski boot by applying a pressure to the thrust member 13, when the ski boot is in the position shown in FIG. 1, so that the end 5 of the ski boot can be lifted away from the transverse member 8. When the pressure is released, the ski binding then returns to its position as shown in FIG. 1.

In the embodiment shown in FIGS. 4 through 7, the cross-country ski binding is generally denoted by reference numeral 21. It is fixed on a cross-country ski 23 by means of screws 22. A cross-country ski boot which is indicated in dash-dotted lines is denoted by reference numeral 24 and has a forwardly extended front end 25 of its sole, formed as a downwardly open hook.

The ski binding includes a base plate 26 with upwardly extending side jaws 27 in which a transverse member 28 is mounted. The transverse member 28 serves for co-operating with the hooked end 25 of the sole. Mounted on the transverse member, by means of its limb portions 30, is a U-shaped stirrup member which, when the cross-country ski boot is fitted into position, embraces the front end of the sole thereof and secures it by means of its web portion 29 to prevent it from lifting away from the transverse member 28.

Just as in the case of the cross-country ski binding shown in FIGS. 1 through 3, the stirrup member forms a crank arm to which a thrust member 33 is connected by way of a journal member 32. The thrust member 33 bears by way of a projection 34 against the base plate 26. Fitted on the journal member 32 is a coil torsion spring 31 of which one leg 35 bears against the web portion 29 of the stirrup member while the other leg 36 thereof bears against the thrust member 33.

Mounted on the thrust member 33 is a locking lever 40, on a pivot mounting spindle 44, which is disposed parallel to the journal member 32. Fitted on the spindle 44 there is also a coil torsion spring 43 of which one leg 45 is against the thrust member 33 while the other leg 46 thereof bears against the locking lever 40 and urges it in the clockwise direction in relation to the drawings. The locking lever has a lock hook or catch 41 which serves to co-operate with a co-operating hook or catch 42 on the base plate 26. The locking lever is also provided on its top side with a depression 47 which serves for inserting the tip of a ski stick.

The cross-country ski binding according to the invention is illustrated in its normal position in FIG. 4. The front end 25 of the sole is secured on the transverse member 28 by the web portion 29 of the stirrup member. For the purposes of moving the ski binding into its open position, a pressure is to be applied to the locking lever 40, for example by means of a ski stick, in the direction of the illustrated arrow. By virtue of that pressure, with a pivotal movement of the stirrup member, the thrust member 33 is displaced towards the left with reference to the drawings until the locking lever 40 can pivot in the anti-clockwise direction and can engage with its locking catch 41 behind the co-operating barb or catch portion 42 on the base plate. The ski binding then takes up its position as shown in FIG. 6. When the ski boot is on the ski, the web portion 29 is at a spacing from the top side of the front end 25 of the sole so that the ski boot can be disengaged from the transverse member 28.

The spring 31 which is substantially stronger than the spring 43 secures the mechanism in the open position.

The ski boot can be fitted into the ski binding again, by the reverse movements from those described above.

After the front end 25 of the sole has been hooked on the transverse member 28, the ski binding can be closed by upward pivotal movement of the rearward end of the ski boot, with the stirrup member being entrained in that movement. More specifically, when that occurs, the catch hook 41 of the locking lever 40 comes free from the catch portion 42 of the base plate 26 and the mechanism is in the instantaneous condition illustrated in FIG. 7.

In contrast to the construction shown in FIGS. 1 through 3, once this construction is moved into its open position, it remains in that position so that the ski binding is immediately ready to receive the ski boot.

Finally, FIGS. 8 through 11 illustrate an embodiment which is further simplified in comparison with that described hereinbefore. The cross-country ski binding is generally denoted by reference numeral 51 and is again secured on a cross-country ski 53 by means of screws 52. A cross-country ski boot is again indicated in dash-dotted lines and denoted by reference numeral 54. It has a forwardly extended end 55 on its sole, which terminates in a bead-like downwardly extending hook.

As in the case of the embodiments described hereinbefore, the binding includes a base plate 56 with upwardly extending side jaws 57 in which a transverse member 58 is mounted. Mounted on the transverse member 58 is a U-shaped stirrup member formed from a web portion 59 and two limb portions 60, with the stirrup member being mounted on the transverse member 58 more specifically by means of the free ends of its limb portions. The web portion 59 is of a cradle-like configuration so that, as can be seen from FIGS. 8 and 11, it can accommodate the bead-like hook at the end 55 of the sole of the ski boot.

A tongue portion 61 which is formed on the web portion 59 has a hole into which is fitted one end of a coil tension spring 62, the other end of which is attached to a spindle 63 which is mounted in the side jaws 57 in parallel relationship to the transverse member 58. Mounted on the spindle 63 is a locking lever 64 which co-operates with the limb portions 60 of the stirrup member in a manner which is still to be described herein. The locking lever is loaded in the direction of unlocking by a holding spring which is in the form of a coil torsion spring 65 and which is fitted onto the spindle 63 (see in particular FIG. 9). On its top, the locking lever also has a depression 66 which serves for fitting the tip of a ski stick therein.

FIG. 8 shows the cross-country ski binding in its normal position. The forwardly extended end 55 of the sole engages with the hook which extends downwardly in a bead-like configuration thereon, into the cradle-like web portion 59 of the stirrup member. The front end of the sole is clamped in position between the web portion 59 and the transverse member 58 and is thus securely held in the binding. Then, in the course of cross-country skiing, there is a continuing change in position between the positions shown in FIGS. 8 and 11, with the transverse member 58 forming the pivot axis. The pivotal movement of the stirrup member from the position shown in FIG. 8 into the position shown in FIG. 11 takes place against the progressively increasing resistance of the coil tension spring 62.

For the purposes of moving the ski binding from the normal position shown in FIG. 8 into its open position, the locking lever 64 is to be moved downwardly, that is to say it is to be pivoted in a clockwise direction with reference to the drawings about the spindle 63, against the force of its holding spring 65, for example by means of a ski stick. When that movement occurs, bent-over side portions 67 of the locking lever each bear against a respective limb portion 60 of the stirrup member so that the stirrup member is pivoted about the transverse member 58 from its position shown in FIG. 8 into the position shown in FIG. 10. That pivotal movement causes the clamping connection between the end 55 of the sole of the boot and the transverse member 58 to be released so that the boot can be removed from the binding by lifting the front end of the sole away from the web portion 59.

The stirrup member is pivoted against the force of the coil tension spring 62 which is substantially stronger than the holding spring 65 for the locking lever 64. As a result, the locking lever remains in its downwardly depressed position as shown in FIG. 10 as the holding spring 65 is unable to overcome the clamping force exerted on the locking lever by the stirrup member. Therefore, once moved into its open position as defined above, the ski binding is ready to receive the ski boot.

For the purposes of connecting the cross-country ski boot to the binding, referring to FIG. 10, the end 55 of the sole is to be fitted into the stirrup member. Then, the boot only has to be lifted at its rear as illustrated in FIG. 11, whereby the front end of the sole is clamped in position under the transverse member 58. By virtue of the pivotal movement of the stirrup member, the locking lever 64 is released therefrom and, under the force of the holding spring 65, moves back into its upper limit position as shown in FIGS. 11 and 8.

I claim:

1. A cross-country ski binding for cross-country ski boots having a forwardly extended front sole end portion, which is formed as a downwardly directed hook means, comprising a base plate mountable on a ski, a pair of side jaws extending upwardly from said base plate on opposite sides thereof for holding said front sole end portion therebetween, engagement means for cooperation with said hook means, a transverse member mounted in said side jaws and transversely extending therebetween, a U-shaped stirrup member having a web portion extending parallel with respect to said transverse member and having a pair of limb portions each projecting from a respective end of said web portion and having a free end by means of which said stirrup member is pivotably mounted on said transverse member so as to be pivotable into a clamping position, wherein said front sole end portion when engaged with said engagement means is clamped between said transverse member and said engagement means, and a release position, wherein said hook means may be released from said engagement means, spring means for urging said stirrup member towards said clamping position, and a locking lever which is pivotable about an axis substantially parallel to said transverse member between a locking position and an unlocking position, and which is loaded towards said unlocking position by a spring, whereby in said locking position the locking lever cooperates with said stirrup member so as to hold same in said release position.

2. A cross-country ski binding according to claim 1, wherein said web portion is provided with a cradle which extends in the longitudinal direction of the ski and forms said engagement means.

3. A cross-country ski binding according to claim 2, wherein said spring means is a coil tension spring having ends by which it is attached to the stirrup member and to said base plate, respectively, and wherein a portion of said locking lever in the locking position thereof extends into the pivot path of the stirrup member so as to prevent pivoting of the stirrup member and to hold same in said release position.

4. A cross-country ski binding according to claim 3, wherein said axis of said locking lever is formed by a spindle mounted in said side jaws of the base plate, and wherein said coil tension spring by one of its ends is attached to said spindle.

* * * * *